US009173544B2

(12) United States Patent
Ayvazoglu et al.

(10) Patent No.: US 9,173,544 B2
(45) Date of Patent: Nov. 3, 2015

(54) DISHWASHER COMPRISING A CUTLERY BASKET

(75) Inventors: Cumhur Ayvazoglu, Istanbul (TR); Sena Davasligil, Istanbul (TR); Mehmet Durmaz, Istanbul (TR); Nihat Gunduz, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 856 days.

(21) Appl. No.: 13/322,110

(22) PCT Filed: May 20, 2010

(86) PCT No.: PCT/EP2010/056975

§ 371 (c)(1),
(2), (4) Date: Jan. 20, 2012

(87) PCT Pub. No.: WO2010/133674

PCT Pub. Date: Nov. 25, 2010

(65) Prior Publication Data

US 2012/0118337 A1 May 17, 2012

(30) Foreign Application Priority Data

May 22, 2009 (TR) ..... a 2009 03962

(51) Int. Cl.
*A47L 15/50* (2006.01)

(52) U.S. Cl.
CPC ..... *A47L 15/502* (2013.01)

(58) Field of Classification Search
CPC ..... A47L 15/502
See application file for complete search history.

(56) References Cited

U.S. PATENT DOCUMENTS

| | | | | |
|---|---|---|---|---|
| 6,161,718 | A * | 12/2000 | Monbo | 220/486 |
| 2004/0020875 | A1 | 2/2004 | Rosenbauer et al. | |

FOREIGN PATENT DOCUMENTS

| | | | | |
|---|---|---|---|---|
| GB | 2422771 | A | 8/2006 | |
| WO | 2006/016759 | A1 | 2/2006 | |
| WO | 2006/063899 | A1 | 6/2006 | |
| WO | 2008/077761 | A1 | 7/2008 | |
| WO | WO2008/077761 | A1 * | 7/2008 | A47L 15/50 |
| WO | WO2009/132949 | A1 * | 11/2009 | A47L 15/50 |

* cited by examiner

*Primary Examiner* — Michael Barr
*Assistant Examiner* — Jason Riggleman
(74) *Attorney, Agent, or Firm* — Venjuris P.C.

(57) ABSTRACT

The present invention relates to a dishwasher (1) comprising cutlery basket (2) which is utilized for cutlery such as fork and spoon to be disposed in an effective washing position, and which has a main body (3) wherein the cutlery are disposed, and an auxiliary body (4) that is fitted inside or outside the main body (3) such that the auxiliary body (4) and the main body (3) will be within each other.

6 Claims, 3 Drawing Sheets

DISHWASHER COMPRISING A CUTLERY BASKET

Figure 1:
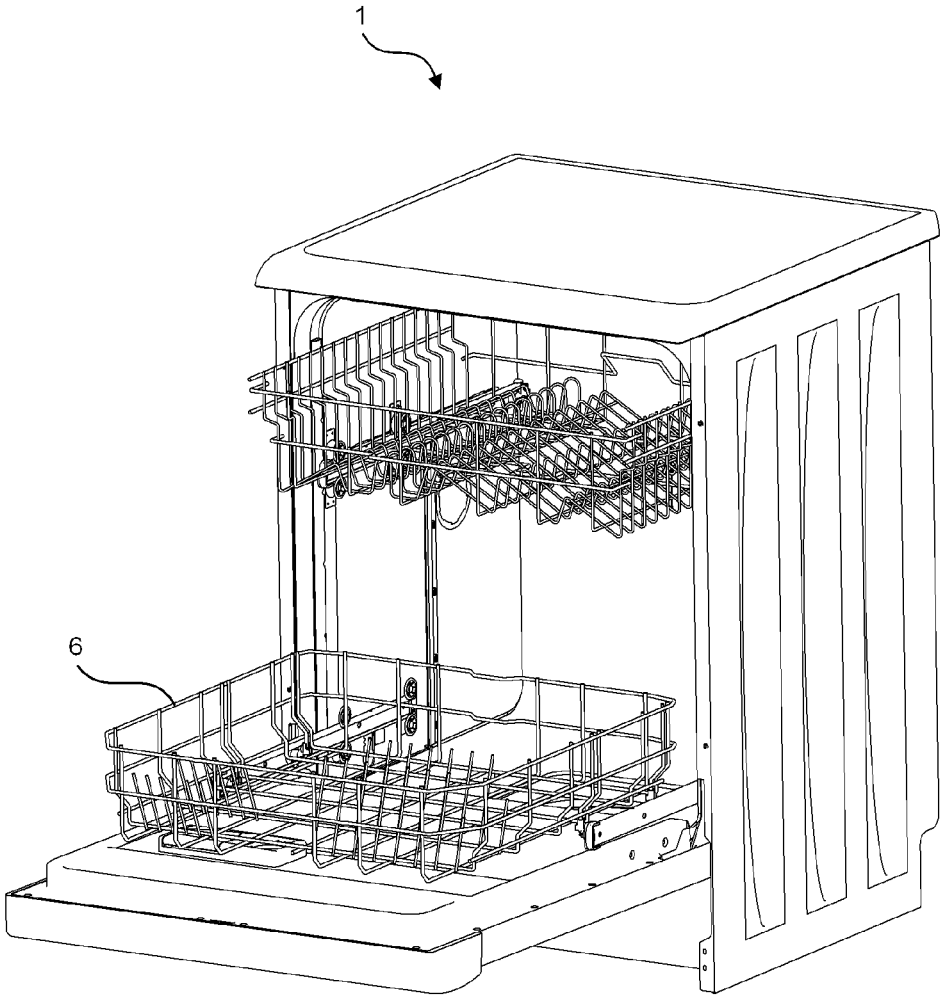

The present invention relates to a dishwasher comprising a cutlery basket.

In dishwashers, cutlery baskets providing the items having small volumes to be washed are utilized. Forks, spoons and knives disposed in the cutlery baskets are generally taken out by being held from the end portions, which will contact the food, while being taken out after washing, and this situation causes a problem in terms of hygiene. Furthermore, for example, when knives are tried to be taken out by being held from their sharp and pointed ends, injuries can happen.

In the state of the art Patent Application No US2004/0020875, an insert is described which is utilized in dishwashers and consists of compartments of various heights, and wherein silverware of different heights are disposed.

In the state of the art International Patent Application No WO2008077761, a cutlery basket is described which is utilized in dishwashers and which comprises a body wherein small sized items such as forks, spoons etc. are placed, and a base that carries the items placed in the body and that can be moved upwards and downwards inside the body and when moved upwards in the body pushes upwards the items thereon such that the ends of the items project outwards from the lid.

However, in this embodiment, when the base is moved upwards, the user is required to hold the body with one hand while holding the handle with the other hand in order that the body can remain balanced, and this causes difficulty of use.

The aim of the present invention is the realization of a dishwasher comprising a cutlery basket which is utilized for disposing cutlery such as fork and spoon therein, and that provides the user both hygienic and ergonomic conditions of use.

The dishwasher realized in order to attain the aim of the present invention is explicated in the claims.

The dishwasher of the present invention comprises a cutlery basket which has a main body wherein cutlery such as fork and spoon are disposed and an auxiliary body, which is disposed within the main body; and in which the height of the auxiliary body can be changed by being moved upwards and downwards with respect to the main body. The auxiliary body is fastened to the main body such that its side walls will surround the side walls of the main body from the inside or outside. By the auxiliary body being moved upwards, the side walls of the auxiliary body are positioned on the side walls of the main body. In this situation, the auxiliary body is in its highest possible position. When the auxiliary body is moved downwards and hence its side walls surround the side walls of the main body from the inside or outside, the auxiliary body is in its lowest possible position.

Washing the items disposed in the cutlery basket is realized in the position wherein the auxiliary body is in its highest position. Thus, items are provided to remain more balanced by bearing against the walls of the main body and auxiliary body. During the loading or unloading of the items, the auxiliary body is moved downwards and fitted inside or outside the main body. Thus, the auxiliary body is situated in its lowest possible position and the height of the cutlery basket becomes almost equal to the height of the main body. Accordingly, hygienic conditions of use are created by facilitating the access to the handle portions of the items.

The auxiliary body is shaped as a box with two open sides and is fitted inside or outside the main body, which is shaped as a box with one open side and which has a base that carries the items disposed therein, such that the open sides will face the same direction. By means of the auxiliary body having two open sides, the auxiliary body is easily moved upwards and downwards even when the cutlery basket is loaded with items.

Protrusion formed chamber supports, which extend almost parallel to the base, are located on the lower edges of the side walls of the auxiliary body. The dishwasher comprises pushers which are located opposite to one another on the rack and which prevent the auxiliary body from moving downwards by the chamber supports being seated on them when the cutlery basket is disposed between them. The auxiliary body is provided to be positioned on the main body by the chamber supports being seated onto the pushers. Thus, items are disposed in a more balanced manner by bearing against the main body and auxiliary body walls that stand one on top of the other. When the cutlery basket is taken out of the dishwasher and disposed on a flat ground, the auxiliary body falls downward by its own weight, and the auxiliary body and the main body fit into each other. In this situation, the side walls of the auxiliary body surround the side walls of the main body from the inside or outside, and the height of the cutlery basket becomes almost equal to the height of the main body. Thus, the user can realize the loading or unloading processes of the cutlery basket by contacting the item portions that do not contact foods.

The cutlery basket comprises a handle that is connected to the auxiliary body and that serves to carry the auxiliary body and the main body together.

In an embodiment of the present invention, the cutlery basket comprises a locking mechanism that serves to hold the main body and the auxiliary body together. Thus, the main body and the auxiliary body are prevented from being detached from each other.

In a version of this embodiment, the cutlery basket comprises one or more separators that are located on the base and that separate the main body into compartments. The locking mechanism comprises a housing located on the separators, and a stud, one end of which is seated into the housing such that it will be able to move upwards and downwards inside the housing, and the other end is connected to the handle. Stoppers, which determine the distance of the upward and downward movement of the auxiliary body, are located on the stud. The downward movement of the auxiliary body is limited by the stoppers bearing against the upper end of the housing.

By means of the present invention, the user is provided to contact the handle portions of the items during the loading and unloading of the cutlery such as fork and spoon and thus, hygienic conditions of use are provided.

The dishwasher realized in order to attain the aim of the present invention is illustrated in the attached figures, where:

FIG. 1—is the perspective view of a dishwasher.

Figure 2:
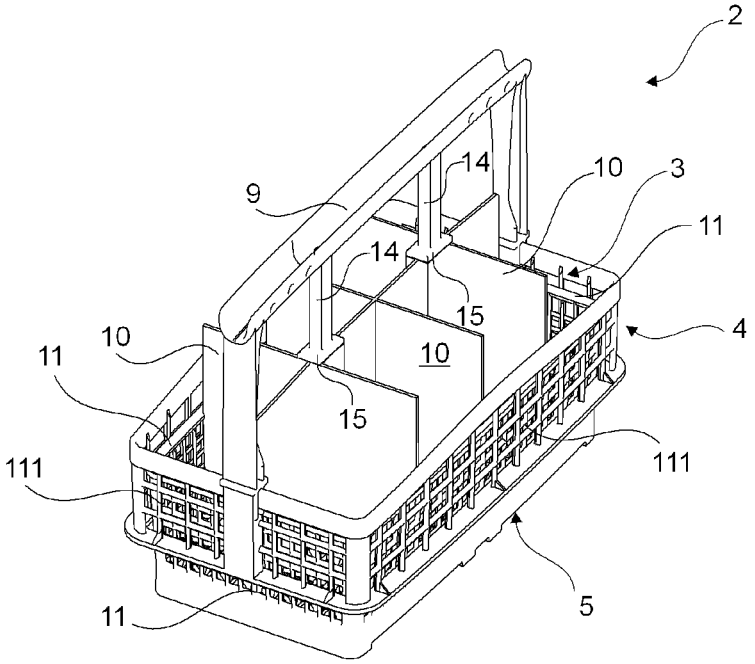

FIG. 2—is the perspective view of a cutlery basket in the position wherein the lower body and the upper body are situated one within the other.

Figure 3:
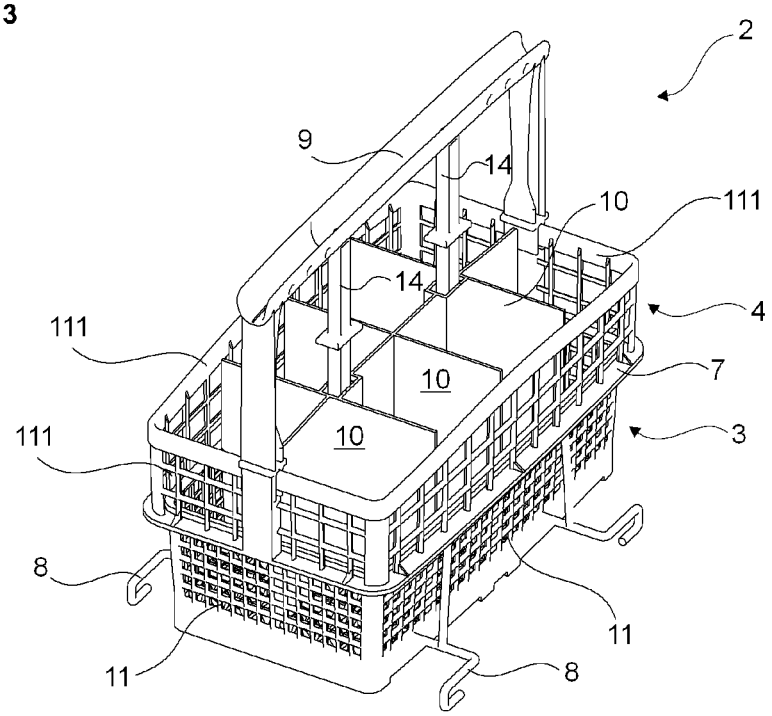

FIG. 3—is the perspective view of a cutlery basket in the position wherein the lower body and the upper body are situated one on top of the other.

Figure 4:
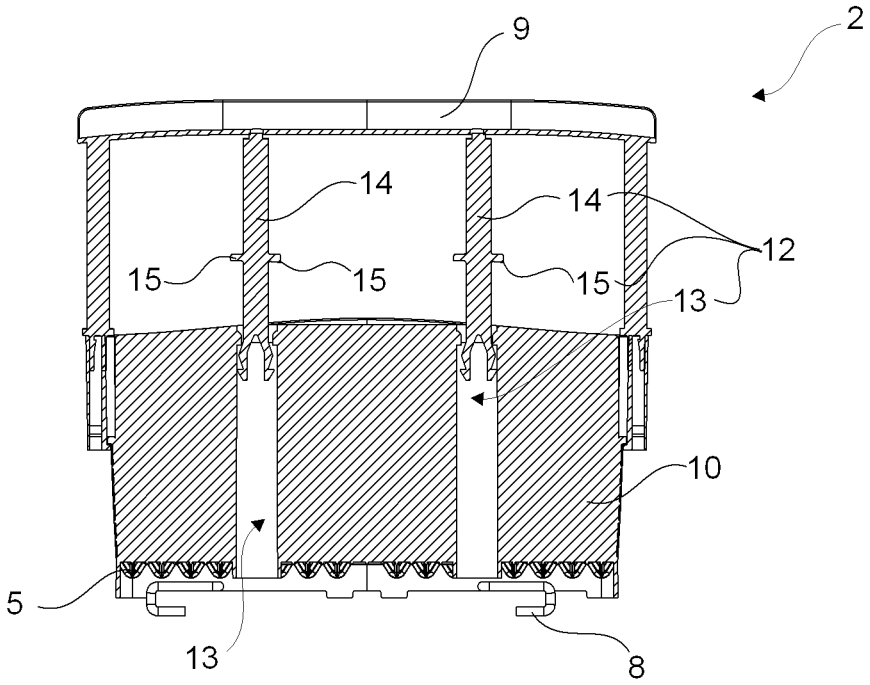

FIG. 4—is the cross-sectional view of a cutlery basket in the position wherein the lower body and the upper body are situated one on top of the other.

The elements illustrated in the figures are numbered as follows:

1. Dishwasher
2. Cutlery basket
3. Main body
4. Auxiliary body
5. Base
6. Rack

7. Chamber support
8. Pusher
9. Handle
10. Separator
11, 111 Side wall
12. Locking mechanism
13. Housing
14. Stud
15. Stopper The dishwasher (1) of the present invention comprises a cutlery basket (2) having a main body (3) which has a base (5) that carries the cutlery such as fork and spoon, and side walls (11) that surround the base (5), an auxiliary body (4) which is shaped as a box with two open sides and has side walls (111), and the side walls (111) of which are fitted to the main body (3) such that they will at least partially surround the side walls (11) of the main body (3) from the inside or outside, and can be telescopically moved with the main body (3) as one being within the other The auxiliary body (4) is fastened to the main body (3) such that it can move upwards and downwards by the auxiliary body (4) and the main body (3) being fitted into each other. The height of the cutlery basket (2) can be changed by means of the telescopic movement the auxiliary body (4) performs with the main body (3) as one being within the other. When the auxiliary body (4) is brought to the lowest position by being moved on the main body (3), its side walls (111) surround the side walls (11) of the main body (3) from the inside or outside, and the cutlery basket (2) is at its minimum possible height. Since the side walls (11) of the main body (3) and the side walls (111) of the auxiliary body (4) overlap with each other in this position, the total height of the cutlery basket (2) is almost equal to the height of the side walls (11) of the main body (3). The process of loading the cutlery into the cutlery basket (2) before the washing or unloading the cutlery from the cutlery basket (2) after the washing is realized in the position wherein the side walls (11, 111) overlap with each other. Thus, the user performs the loading and unloading processes by holding the items from their handle portions instead of their utilized portions and hence hygienic conditions of use are created in terms of the user. Furthermore, possible injuries are avoided by preventing the user from contacting the sharp and pointed ends of the items such as knife. In the position wherein the washing is realized by disposing the cutlery basket (2) into the dishwasher (1) after the placement of the cutlery, the auxiliary body (4) is brought to the uppermost position by being moved upwards. In this position wherein the main body (3) and the auxiliary body (4) are situated one on top of the other, the cutlery basket (2) is at its greatest possible height. In this position, the height of the cutlery basket (2) is almost equal to the sum of the height of the main body (3) side walls (11) and the height of the auxiliary body (4) side walls (111). Thus, the items disposed in the cutlery basket (2) are provided to bear against the side walls and the items are provided to remain in a more balanced manner in the cutlery basket (2).

The auxiliary body (4) is fitted inside or outside the main body (3) such that its open side will face the same direction as the open side of the main body (3). The main body (3) and the auxiliary body (4) are provided to use the base (5) commonly by being fitted into each other. By means of the auxiliary body (4) having two open sides, the auxiliary body (4) is moved upwards and downwards even when the cutlery basket (2) is loaded with items.

The auxiliary body (4) comprises chamber supports (7) that are located on the lower edges of its side walls (111) and extend almost parallel to the base (5).

The dishwasher (1), furthermore, comprises a rack (6) and at least two pushers (8) which are disposed oppositely on the rack (6) and prevent the auxiliary body (4) from moving downwards by the chamber supports (7) bearing against them when the cutlery basket (2) is disposed between them. The pushers (8) have a distance between them as wide as the main body (3). In the position wherein the cutlery basket (2) is disposed into the dishwasher (1) and the items therein are washed, the chamber supports (7) contact the pushers (8) and thus, the auxiliary body (4) is provided to remain above the main body (3) in the highest position. When the cutlery basket (2) is taken out of the dishwasher (1) and disposed on a flat ground for loading or unloading items, the auxiliary body (4) falls downward freely by its own weight. Thus, by the auxiliary body (4) being fitted inside or outside the main body (3), the height of the cutlery basket (2) is shortened such that it will be almost equal to the height of the main body (3). The user can easily reach the handle portions of the items inside the cutlery basket (2), the height of which is shortened, and thus, the user is presented with a more hygienic and ergonomic usage opportunity.

In an embodiment of the present invention, the cutlery basket (2) comprises a handle (9) that is connected to the auxiliary body (4) and that serves to carry the auxiliary body (4) and the main body (3) together. By means of the handle (9), the auxiliary body (4) is moved between the uppermost and the lowermost positions by means of the force applied to the handle (9) by the user. Furthermore, changing the cutlery basket (2) from the position wherein the main body (3) and the auxiliary body (4) are situated one on top of the other to the position wherein the main body (3) and the auxiliary body (4) are situated one within the other is possible by releasing the handle (9).

In another embodiment of the present invention, the cutlery basket (2) comprises a locking mechanism (12) that serves to hold the main body (3) and the auxiliary body (4) together. Thus, the main body (3) and the auxiliary body (4) are prevented from being detached from each other.

In a version of this embodiment, the cutlery basket (2) comprises one or more separators (10) that are located on the base (5) and that separate the main body (3) into compartments. The locking mechanism (12) comprises at least one housing (13) located on the separators (10), and at least one stud (14), one end of which is seated into the housing (13) by being stretched, and the other end is connected to the handle (9). The stud (14) is seated into the housing (13) such that it will prevent the main body (3) and the auxiliary body (4) from being detached from each other. During the upward and downward movement performed by the auxiliary body (4) to the main body (3), the stud (14) moves upwards and downwards inside the housing (13), too. The locking mechanism (12), furthermore, comprises at least one stopper (15) which is located on the stud (14) and which limits the movement of the auxiliary body (4) by bearing against the upper end of the housing (13) during the downward movement of the auxiliary body (4). By means of the stopper (15), the movement distance performed by the auxiliary body (4) in the vertical direction is controlled.

In another embodiment of the present invention, the height of the separators (10) is almost equal to the sum of the heights of the main body (3) and auxiliary body (4).

By means of the present invention, a dishwasher (1) comprising a cutlery basket (2) that is utilized for disposing cutlery such as fork and spoon, and that provides the user hygienic and ergonomic conditions of use is obtained.

It is to be understood that the present invention is not limited to the embodiments disclosed above and a person skilled in the art can easily introduce different embodiments. These should be considered within the scope of the protection postulated by the claims of the present invention.

The invention claimed is:

1. A dishwasher (1) characterized by a cutlery basket (2) which comprises a main body (3) which has a base (5) that carries the cutlery such as fork and spoon, and side walls (11) that surround the base (5), an auxiliary body (4) which is shaped as a box with two open sides and has side walls (111), and the side walls (111) of which are fitted to the main body (3) such that they will at least partially surround the side walls (11) of the main body (3) from the inside or outside, and can be telescopically moved with the main body (3) as one being within the other wherein the auxiliary body (4) which comprises chamber supports (7) that are located on the lower edges of its side walls (111) and extend almost parallel to the base (5) and further comprising a rack (6) and at least two pushers (8) which are disposed oppositely on the rack (6) and prevent the auxiliary body (4) from moving downwards by the chamber supports (7) bearing against them when the cutlery basket (2) is disposed between them and wherein the cutlery basket (2) further comprises a handle (9) that is connected to the auxiliary body (4) and that serves to carry the auxiliary body (4) and the main body (3) together, one or more separators (10) that are located on the base (5) and that separate the main body (3) into compartments and a locking mechanism (12) that serves to hold the main body (3) and the auxiliary body (4) together and wherein the locking mechanism (12) that comprises at least one housing (13) located on the separators (10), and at least one stud (14), one end of which is seated into the housing (13) by being stretched, and the other end is connected to the handle (9).

2. The dishwasher (1) as in claim 1, wherein the locking mechanism (12) that comprises at least one stopper (15) which is located on the stud (14) and which limits the movement of the auxiliary body (4) by bearing against the upper end of the housing (13) during the downward movement of the auxiliary body (4).

3. A dishwasher (1) characterized by a cutlery basket (2) which comprises a main body (3) which has a base (5) that carries the cutlery such as fork and spoon, and side walls (11) that surround the base (5), an auxiliary body (4) which is shaped as a box with two open sides and has side walls (111), and the side walls (111) of which are fitted to the main body (3) such that they will at least partially surround the side walls (11) of the main body (3) from the inside or outside, and can be telescopically moved with the main body (3) as one being within the other wherein the auxiliary body (4) which comprises chamber supports (7) that are located on the lower edges of its side walls (111) and extend almost parallel to the base (5) and further comprising a rack (6) and at least two pushers (8) which are disposed oppositely on the rack (6) and prevent the auxiliary body (4) from moving downwards by the chamber supports (7) bearing against them when the cutlery basket (2) is disposed between them and wherein the cutlery basket (2) further comprises one or more separators (10) that are located on the base (5) and that separate the main body (3) into compartments and a locking mechanism (12) that serves to hold the main body (3) and the auxiliary body (4) together and the locking mechanism (12) that comprises at least one housing (13) located on the separators (10), and at least one stud (14), one end of which is seated into the housing (13) by being stretched, and the other end is connected to the handle (9).

4. The dishwasher (1) as in claim 3, the locking mechanism (12) that comprises at least one stopper (15) which is located on the stud (14) and which limits the movement of the auxiliary body (4) by bearing against the upper end of the housing (13) during the downward movement of the auxiliary body (4).

5. A dishwasher (1) characterized by a cutlery basket (2) which comprises a main body (3) which has a base (5) that carries the cutlery such as fork and spoon, and side walls (11) that surround the base (5), an auxiliary body (4) which is shaped as a box with two open sides and has side walls (111), and the side walls (111) of which are fitted to the main body (3) such that they will at least partially surround the side walls (11) of the main body (3) from the inside or outside, and can be telescopically moved with the main body (3) as one being within the other wherein the auxiliary body (4) which comprises chamber supports (7) that are located on the lower edges of its side walls (111) and extend almost parallel to the base (5) and further comprising a rack (6) and at least two pushers (8) which are disposed oppositely on the rack (6) and prevent the auxiliary body (4) from moving downwards by the chamber supports (7) bearing against them when the cutlery basket (2) is disposed between them and wherein the cutlery basket (2) further comprises a locking mechanism (12) that serves to hold the main body (3) and the auxiliary body (4) together and the locking mechanism (12) that comprises at least one housing (13) located on the separators (10), and at least one stud (14), one end of which is seated into the housing (13) by being stretched, and the other end is connected to the handle (9).

6. The dishwasher (1) as in claim 5, the locking mechanism (12) that comprises at least one stopper (15) which is located on the stud (14) and which limits the movement of the auxiliary body (4) by bearing against the upper end of the housing (13) during the downward movement of the auxiliary body (4).

* * * * *